US007163129B1

(12) United States Patent
Bennett

(10) Patent No.: US 7,163,129 B1
(45) Date of Patent: Jan. 16, 2007

(54) TABLET DISPENSING MECHANISM FOR USE WITH BEVERAGE CONTAINERS

(76) Inventor: Douglas A. Bennett, 25-506 Barker St., Mount Kisco, NY (US) 10549-1633

( * ) Notice: Subject to any disclaimer, the term of this patent is extended or adjusted under 35 U.S.C. 154(b) by 0 days.

(21) Appl. No.: 10/218,924

(22) Filed: Aug. 15, 2002

(51) Int. Cl.
*B67D 1/07* (2006.01)

(52) U.S. Cl. ..... 222/192; 221/25; 221/199; 206/222

(58) Field of Classification Search ..... 221/3, 221/7, 13, 199, 25, 26; 222/192, 80; 206/219, 206/222
See application file for complete search history.

(56) References Cited

U.S. PATENT DOCUMENTS 3,446,179 A 5/1969 Bender
3,695,487 A 10/1972 Slayton et al.
4,127,645 A 11/1978 Witzel et al.
4,159,791 A 7/1979 Crutcher
4,546,002 A 10/1985 Leshik et al.
4,569,852 A 2/1986 Yang
4,785,931 A * 11/1988 Weir et al. ..... 206/222
4,919,960 A 4/1990 Ahmed et al.
5,123,574 A 6/1992 Poulos
5,431,276 A * 7/1995 Lialin ..... 206/222
5,979,647 A * 11/1999 Han ..... 206/222
6,138,866 A * 10/2000 Lambelet et al. ..... 221/25

* cited by examiner

*Primary Examiner*—Patrick Mackey
*Assistant Examiner*—Mark Hageman
(74) *Attorney, Agent, or Firm*—Donald R. Schoonover

(57) ABSTRACT

A storage unit is rotatably mounted on one end of a liquid beverage container and contains a plurality of packets. Each packet has a flexible top and a frangible bottom and a flavored tablet is stored in each packet. The tablets dissolve in the liquid stored in the container when dropped thereinto and can be of various flavors to add flavors to the liquid contained in the container.

2 Claims, 3 Drawing Sheets

TABLET DISPENSING MECHANISM FOR USE WITH BEVERAGE CONTAINERS

BACKGROUND OF THE INVENTION

1. Field of the Invention

The present invention relates to the general art of containers, and to the particular field of accessories for liquid containers.

2. Discussion of the Related Art

Liquid beverages of all kinds are sold in containers. These containers are convenient for the manufacturer, for the shipper, for the seller, and for the consumer. Accordingly, the popularity of such food items has increased over time and continues to increase.

The variety of liquid beverages also increases each year. These beverages range from simple water and fruit drinks, to complex liquid combinations as well as to carbonated and alcoholic beverages. The containers range from simple bottles to cans and other containers. The variety of both the beverage and the container is at the present time only limited by the imagination of the beverage manufacturers and sellers.

However, therein lies a drawback. The variety of liquid beverages available to the consuming public is limited to what is offered by the manufacturers. However, consumers as a whole, may desire a wider variety of beverages than can be economically offered by manufacturers. Thus, a consumer may envision a beverage taste that is simply not readily available resulting in a manufacturer losing sales.

Therefore, there is a need for a means for providing liquid beverages to consumers which can readily meet consumer desires.

However, manufacturers cannot economically manufacture a range of liquid beverages that is sufficiently broad enough to meet the desires of every consumer.

Therefore, there is a need for a means for economically providing a broad range of liquid beverages to consumers.

Presently, many consumers mix beverages together in order to achieve a desired liquid beverage flavor. This may require the individual to purchase several different flavored drinks to form a single drink. This may be quite wasteful and expensive. Even if a fountain is available, the fountain may not have a particular flavor desired by a consumer.

Therefore, there is a need for a means of economically providing a broad range of liquid beverage tastes to a consumer.

Still further, if the consumer purchases a beverage and changes his or her mind about the flavor of that beverage after consuming some of that beverage, it may be difficult to change the taste of the beverage.

Therefore, there is a need for a means by which a consumer can change the flavor of a beverage after beginning to consume the beverage.

PRINCIPAL OBJECTS OF THE INVENTION

It is a main object of the present invention to provide a means for providing liquid beverages to consumers which can readily meet consumer desires.

It is another object of the present invention to provide a means for economically providing a broad range of liquid beverages to consumers.

It is another object of the present invention to economically provide a broad range of liquid beverage tastes to a consumer.

It is another object of the present invention to provide a means by which a consumer can change the flavor of a beverage after beginning to consume the beverage.

SUMMARY OF THE INVENTION

These, and other, objects are achieved by a mechanism that can be attached to a liquid beverage container and which has a variety of flavored tablets therein. The tablets can be dropped into the liquid beverage to alter the flavor of the beverage in the container. In some cases, the tablets can be effervescent as well.

Thus, for example, a drink such as a cola drink can be flavored by one or more fruit flavors, such as cherry, lime, lemon or the like, by dropping one or more tablets into the liquid after the container is opened. Packets containing one or more of these tablets can be attached to the containers and manipulated by the consumer to flavor a drink.

This permits manufacturers to economically provide a wide variety of drink choices and allows consumers to still further modify even the wide variety of drink choices available. In this manner, manufacturer economics as well as consumer choice range are both satisfied.

The consumer can change the flavor of a beverage even after some of the beverage has been consumed by simply moving the tablet storage unit to a new position and adding another flavored tablet to the beverage. This adds still more variety to the beverage industry.

Still further, in the depicted form of the present invention, the beverage container need not be significantly modified to accommodate the tablets. Thus, manufacturers do not have to invest large amounts of money in re-tooling a container manufacturing or bottling facility.

DETAILED DESCRIPTION OF THE INVENTION

Figure 1:
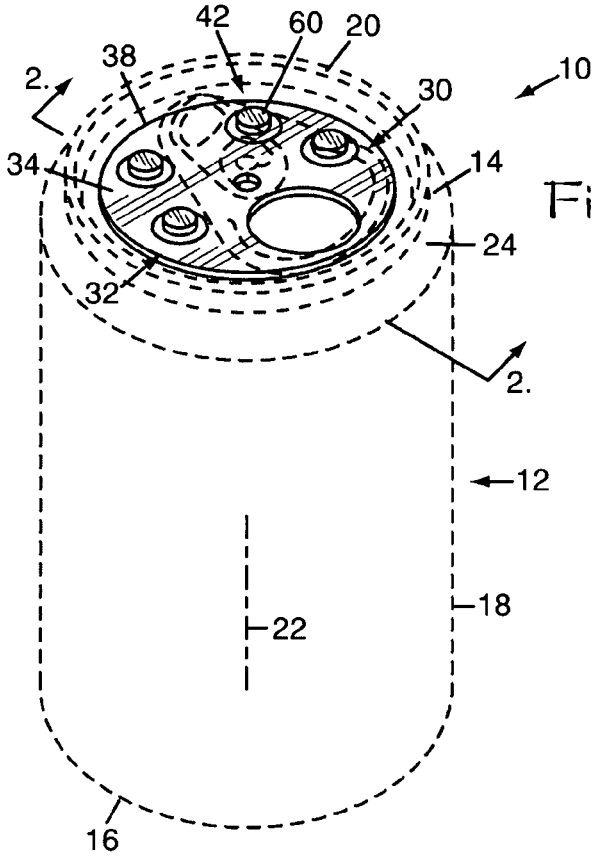
FIG. 1 is a perspective view of a tablet dispensing mechanism mounted inside a liquid beverage container.

Other objects, features and advantages of the invention will become apparent from a consideration of the following detailed description and the accompanying drawings.

The mechanism embodying the present invention is added to a container for a liquid beverage and can store flavored tablets that dissolve when added to the liquid beverage. The flavored tablets can be added to change the flavor of the beverage contained in the container.

Referring to the Figures, it can be understood that the present invention is embodied in a tablet dispensing mechanism 10 for use with a beverage container. Mechanism 10 comprises a liquid beverage container 12 having a top end 14, a bottom end 16, a sidewall 18, a top rim 20 surrounding top end 14, an opening 21, and a longitudinal axis 22 extending between top end 14 and bottom end 16. Top end 14 has an outer surface 24 and an inner surface 26 located between outer surface 24 of top end 14 of container 12 and bottom end 16 of container 12. Container 12 is shown in the shape of a can, but could be other shapes as will occur to those skilled in the art based on the teaching of this disclosure. Container 12 can be formed of metal, glass, paper or any other material suitable for containing beverages. For this reason, container 12 is shown in FIG. 1 in dotted lines.

Figure 2:
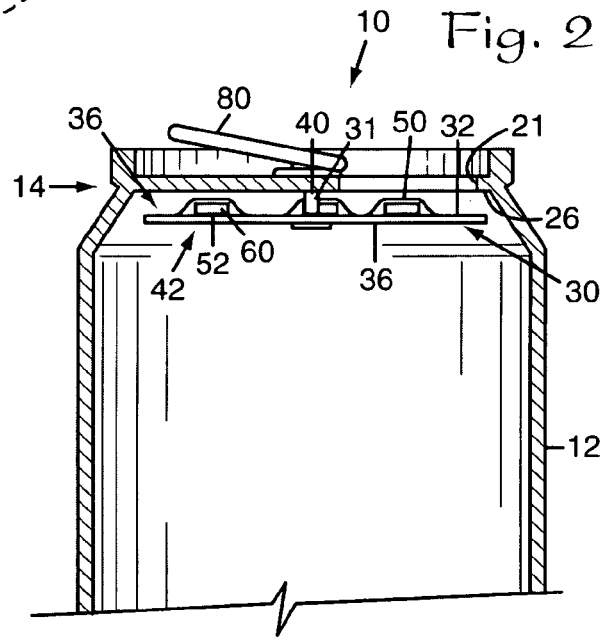
FIG. 2 is a view of the tablet dispensing mechanism taken along line 2—2 of FIG. 1.
Figure 6:
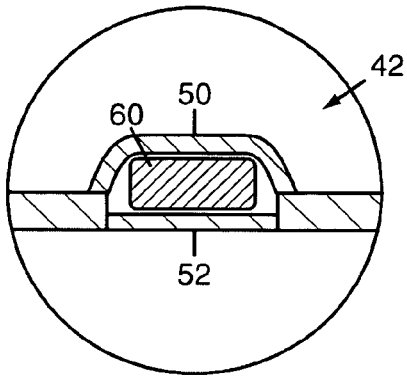
FIG. 6 is an enlarged and fragmentary, cross-sectional view of a packet of the tablet dispensing mechanism, according to the present invention.

As shown in FIGS. 1–2 and 6, mechanism 10 further includes a tablet storage unit 30 rotatably mounted by rivet 31 on the top end 14 and inside of the beverage container 12 and includes a one-piece body 32 having a top surface 34 and a bottom surface 36, an outer circumference 38 and a center 40 with center 40 being located on longitudinal axis 22 of beverage container 12.

Tablet storage unit 30 further includes a plurality of tablet storage packets, such as packet 42, mounted on body 32 of tablet storage unit 30. Tablet storage packets 42 are spaced apart from each other in the direction of the outer circumference 38 of body 30. As shown in FIG. 6, each tablet storage packet 42 includes a flexible top surface 50 located adjacent to top surface 34 of body 32 of tablet storage unit 30 and a frangible or tearable bottom surface 52 located adjacent to bottom surface 36 of body 32 of tablet storage unit 30. Each of the tablet storage packets 42 further includes a favored tablet 60 stored therein. The flavor tablets 60 can be effervescent if desired. The frangible bottom 52 can be similar to the bottoms used in packets containing medicinal pills and the like where the consumer pushes the pill through the bottom of the packet.

Figure 3:
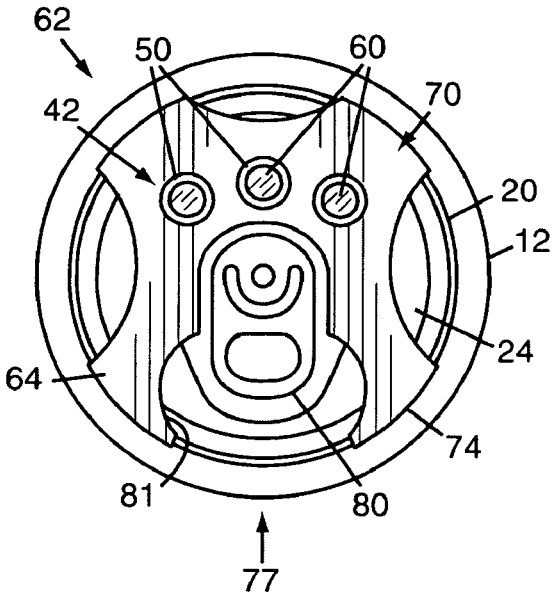
FIG. 3 is a top plan view of a first modified embodiment of the tablet dispensing mechanism, embodying the teaching of the present invention, in place on a beverage container.
Figure 4:
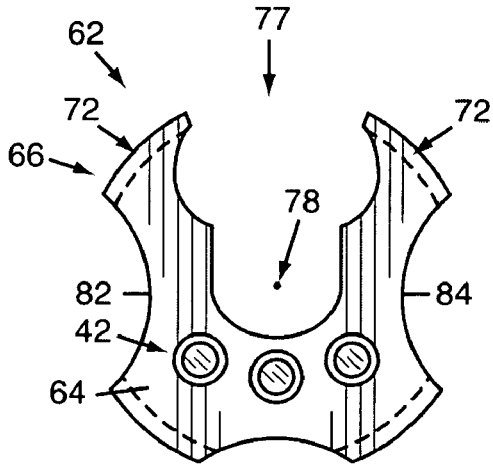
FIG. 4 is top plan view of the first modified embodiment of the tablet dispensing mechanism shown in FIG. 3.
Figure 5:
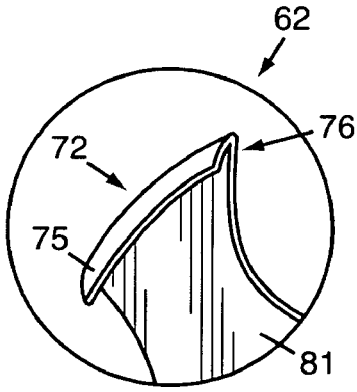
FIG. 5 is a detailed view of a rolled edge of the first modified embodiment of the tablet dispensing mechanism shown in FIGS. 3 and 4.

A first modified embodiment 62 of the tablet dispensing mechanism is shown in FIGS. 3–5 wherein a Tablet storage unit 64 includes a mounting unit 66 rotatably mounting body 70 of tablet storage unit 64 on beverage container 12 adjacent to top end 14. Mounting unit 66 includes a plurality of rolled edges, such as rolled edge 72, on outer circumference 74 of body 32. Each rolled edge 72 includes a cylindrically shaped body 75 having an open mouth 76 to slidably accommodate top rim 20 of beverage container 12 in cylindrically shaped body 75 when the tablet storage unit 64 is mounted on beverage container 12. An opening 77 is defined in body 70 of tablet storage unit 64 and extends from outer circumference 74 of body 70 toward and encompassing center 78 of body 70. Opening 77 is aligned with opening 21 in the top of container 12 when tab 80 of the container 12 is pulled open in a manner known to those skilled in the art. Opening 77 is large enough to permit a user to easily grasp the tab 80 on the container 12 and pull tab 80 in the manner necessary to open the container 12 and then is large enough to permit the user to drink the beverage held by container 12.

Body 70 of tablet storage unit 30 is mounted on top end 14 of drink container 12 to rotate around longitudinal axis 22 of beverage container 12. Body 70 of tablet storage unit 30 is oriented on the top end 14 of beverage container 12 to have bottom surface 81 of body 70 of tablet storage unit 64 positioned adjacent to outer surface 24 of top end 14 of beverage container 12.

Operation of the first modified embodiment 62 of the tablet dispensing mechanism is apparent from the foregoing, and will only be briefly discussed. A user opens the beverage container 12 by pulling the tab 80 in a normal manner thus exposing the beverage dispensing opening 21 in the top 14 of the container 12. The user then rotates the tablet storage unit 64 around the rim 20 of the beverage container 12, such as by the user grasping concave edges 82 and 84 between his or her fingers and physically turning body 70 as needed until the desired flavor tablet 60 is aligned with the opening 21 in the beverage container top end 14. The user then forces downwardly on the flexible top 50 of the selected tablet packet 42 until the tablet 60 is forced through the frangible bottom 52 of the packet 42. The thus-freed tablet 60 drops into the liquid contained in the beverage container 12 and flavors that liquid. Another tablet 60 can be added to further change the flavor of the beverage in the container 12. The flavored beverage can then be consumed through the aligned openings 21 and 77 in the top of the beverage can 12 and in the tablet storage unit 64. If the consumer wishes to change the flavor of the beverage after he or she has begun to consume the beverage, the consumer needs only to rotate the tablet storage unit 64 to position another flavor tablet 60 over the opening 21 in the container 12 and force that new tablet 60 through the frangible bottom 52 of the newly selected packet 42 to add the new flavor to the already-flavored beverage. In this manner, the consumer can have a variety of different tastes for each beverage without purchasing additional beverages.

Figure 7:
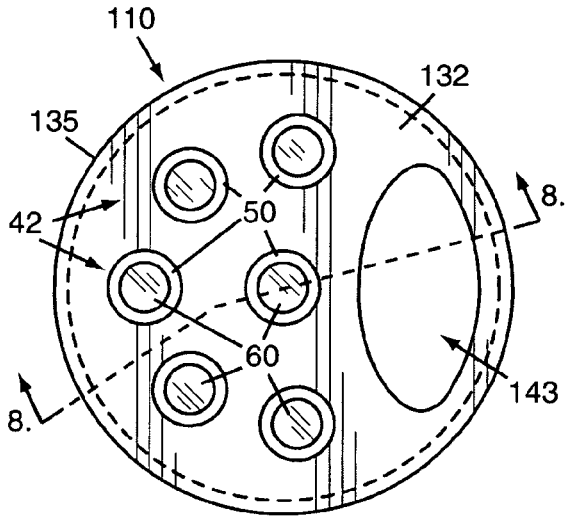
FIG. 7 is a top plan view of a second modified embodiment of the tablet dispensing mechanism for use with a styrofoam cup.
Figure 8:
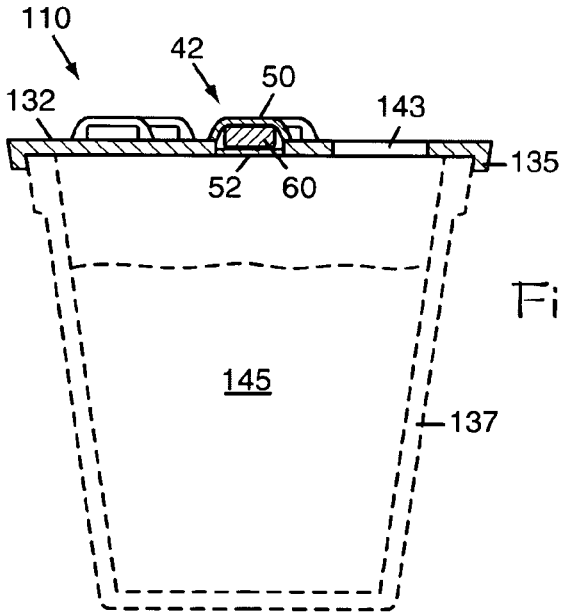
FIG. 8 is a cross-sectional view of the second modified embodiment of the tablet dispensing mechanism, taken along line 8—8 of FIG. 7, according to the present invention.

A second modified embodiment of the tablet dispensing mechanism in accordance with the present invention is shown in FIGS. 7 and 8 and is generally designated by the numeral 110. Many of the characteristics of the second modified embodiment 110 are substantially similar to those of the previously described embodiments and will not be reiterated here in detail. The device 110, as shown in FIG. 7, comprises a circularly-shaped body 132 having a lip 135 that is sized and configured to snugly fit over and around the upper extremity of a disposable beverage container, such as a styrofoam cup 137, as shown in FIG. 8. The device 110 has a opening 143 that permits a user to drink the beverage 145 from the cup 137 without removing the device 110 from the cup 137. Constructed in the body 132 are a plurality of packets 42, each having a flexible top surface 50 and a frangible or tearable bottom surface 52 and each packet 42 containing a flavor tablet 60 for selectively dropping into the underlying beverage 145, as hereinbefore described.

It is understood that while the form of the present invention has been illustrated and described herein, it is not to be limited to the specific forms or arrangements of parts described and shown.

I claim:

1. A tablet dispensing mechanism for use with a beverage container comprising:

a) a liquid beverage container having a top end, a bottom end, a sidewall, a top rim surrounding the top end, a longitudinal axis extending between the top end and the bottom end, an outer surface on the top end of said beverage container, and an inner surface on the top end of said beverage container with the inner surface being located between the outer surface of the top end of said container and the bottom end of said container, and b) a tablet storage unit rotatably mounted on the top end of said beverage container and including (1) a one-piece body having a top surface and a bottom surface, an outer circumference, a plurality of arms which are spaced apart from each other along the direction of the outer circumference, a plurality of cutouts, each cutout being positioned between adjacent arms, and a center with the center of the body of said tablet storage unit being located on the longitudinal axis of said beverage container, (2) a plurality of tablet storage packets mounted on the body of said tablet storage unit, with the tablet storage packets being spaced apart from each other along the direction of the outer circumference of the body of said tablet storage unit, each tablet storage packet including (A) a flexible top surface located adjacent to the top surface of the body of said tablet storage unit, (B) a frangible bottom surface located adjacent to the bottom surface of the body of said tablet storage unit, and (C) a favored tablet stored in each tablet storage packet, (3) a mounting unit rotatably mounting the body of said tablet storage unit on said beverage container adjacent to the top of said beverage container and including a plurality of rolled edges on the outer circumference of the body of said tablet storage unit, with one rolled edge being located on each arm of the body of said tablet storage unit, the rolled edges being spaced apart from each other along a direction of the circumference and having a cutout interposed between adjacent rolled edges, each rolled edge including a cylindrically shaped body having an open mouth and slidably accommodating the top rim of said beverage container in the cylindrically shaped body when said tablet storage unit is mounted on said beverage container, (4) an opening defined in the body of said tablet storage unit and extending from the outer circumference of the body of said tablet storage unit toward the center of the body of said tablet storage unit, (5) the body of said tablet storage unit being mounted on the top of said beverage container to rotate around the longitudinal axis of said beverage container, and (6) the body of said tablet storage unit being oriented on the top of said beverage container to have the bottom surface of the body of said tablet storage unit positioned adjacent to the outer surface of the top end of said beverage container.

2. The tablet dispensing mechanism as described in claim 1 wherein the tablets are effervescent tablets.

* * * * *